US005184117A

United States Patent [19]

Gauthier

[11] Patent Number: 5,184,117

[45] Date of Patent: Feb. 2, 1993

[54] FLUORESCENT BACKLIGHT FLICKER CONTROL IN AN LCD DISPLAY

[75] Inventor: Lloyd W. Gauthier, St. Joseph, Mich.

[73] Assignee: Zenith Data Systems Corporation, St. Joseph, Mich.

[21] Appl. No.: 373,017

[22] Filed: Jun. 28, 1989

[51] Int. Cl.[5] ..... G09G 3/36

[52] U.S. Cl. ..... 340/784; 340/765; 340/814

[58] Field of Search ..... 340/784, 765, 814, 781, 340/784 G, 793, 767; 350/345, 332; 358/241, 236; 359/48

[56] References Cited

U.S. PATENT DOCUMENTS

| | | | |
|---|---|---|---|
| 3,975,661 | 8/1976 | Kanatani et al. | 340/781 |
| 4,669,053 | 5/1987 | Krenz . | |
| 4,769,753 | 9/1988 | Knudson et al. | 320/1 |
| 4,958,915 | 9/1990 | Okada et al. | 350/333 |
| 5,078,476 | 1/1992 | Shin | 340/814 |

FOREIGN PATENT DOCUMENTS

| | | | |
|---|---|---|---|
| 0019835 | 1/1987 | Japan | 350/345 |
| 63-241525 | 3/1987 | Japan | 340/784 |

OTHER PUBLICATIONS

"Microcomputer Displays, Graphics, and Animation" Bruce A. Artwick, 1985, 1984 pp. 64–65.

"Light, Bright, and White" Rash, Wayne, Jr., Byte Magazine, Dec. 1988, pp. 321–324.

*Primary Examiner*—Ulysses Weldon

*Assistant Examiner*—Doon Yue Chow

*Attorney, Agent, or Firm*—Fitch, Even, Tabin & Flannery

[57] ABSTRACT

A personal portable computer having a fluorescent backlit LCD is provided with circuitry for mitigating noticeable flicker of the backlight. The signal driving the backlight is synchronized with the display refresh signal. More particularly, a horizontal sync signal from an LCD driver is applied to a counter which divides the horizontal sync signal by a predetermined amount. The counter is reset after each frame of the display is written by a vertical sync signal. The output of the counter is applied to a pluse width modulator, such as a monostable multivibrator, which provides a signal to the backlight, synchronized with the display refresh signal. The circuitry also allows for the duty cycle of the backlight signal to be adjusted to control the brightness of the display and consequently the power drain on the battery.

20 Claims, 1 Drawing Sheet

FLUORESCENT BACKLIGHT FLICKER CONTROL IN AN LCD DISPLAY

BACKGROUND OF THE INVENTION

1. Field of the Invention

The present invention relates to portable personal computers and, more particularly, to portable personal computers having a fluorescent backlit liquid crystal display (LCD) wherein the backlight flicker is reduced by synchronizing the backlight with the display refresh signal.

2. Description of the Prior Art

Various display technologies have been provided on portable personal computers. For example, cathode ray tube (CRT), LCD, gas plasma and electroluminescent display (EL) technologies are known. Early portable personal computers, such as illustrated in U.S. Pat. No. 4,669,053, assigned to the same assignee as the assignee of the present invention, were provided with CRTs. However, the use of a CRT in a portable personal computer results in a relatively large cabinet size as compared to today's briefcase size portable personal computers.

Gas plasma displays in portable personal computers are also known. These displays are formed from a matrix of electrodes separated by a gas such as neon. By applying a voltage to an addressed matrix intersection, the gas is excited and emits an orange-red light. Even though gas plasma d require no backlighting, they consume relatively more power than other display technologies, such as a backlit LCD. Thus, such gas plasma displays place a relatively large drain on the battery driving the portable personal computer.

Another type of display used on portable personal computers is an EL display. Typical EL displays consist of a thin film of an electroluminescent material, such as phosphor, sandwiched between thin films of an insulating dielectric material, disposed adjacent a matrix of electrodes. When an appropriate voltage is applied to an addressed matrix intersection, the phosphors emit light. However, EL displays require alternating current (AC) and consume relatively more power than an LCD. Since EL displays require AC, they are unsuitable for truly portable personal computers, which are not required to be tethered to an external source of AC.

LCD displays are used on various portable personal computers. LCDs offer many advantages, over other display technologies, such as low power consumption and small size. Typical LCD displays are formed from liquid crystals sandwiched between two optical polarizers. Some known personal computers are provided with reflective type LCD displays. These reflective LCD displays do not produce light, but rather depend on ambient light. Consequently, in conditions of low ambient light, these displays provide low contrast and poor readability. In order to resolve this problem, some LCD displays are now backlit to obviate the dependence of the display on ambient light. Different types of light sources are used for backlighting the LCD display, such as high intensity incandescent light bulbs and high intensity fluorescent lights. The fluorescent backlights require the same amount of power as a high intensity incandescent bulb and last twice as long. Moreover, the fluorescent backlights have almost double the intensity of an incandescent light, thus resulting in a 20 to 1 contrast ratio.

Such fluorescent backlit LCD displays are known to be driven by, for example, a square wave developed from the battery supplying power to the computer. One problem with the fluorescent backlit LCD screen is noticeable flicker. The flicker results from the square wave beating with the display refresh signal. In some known backlit LCDs, the display is refreshed at 70 Hz resulting in the display being completely rewritten 70 times a second. In order to eliminate or reduce the flicker, the backlight has to be operated at substantially the same frequency or at harmonic frequencies of the display refresh signal. If the backlight is operated at the same frequency as the display refresh signal, a relatively close tolerance must be maintained on the frequency. For example, there will be no noticeable flicker on a 70 Hz display when the backlight is also operated at 70 Hz. However, a flicker may be noticeable at 71 Hz. Since the flicker is more noticeable at lower frequencies, the frequency of the backlight is generally driven at a harmonic frequency of the display refresh signal, such as 420 Hz.

The signal for the backlight has heretofore been developed by an oscillator, for example, a tank circuit. However, the problem with using such a tank circuit is that the frequency of the oscillator is greatly affected by tolerances in resistors and capacitors used in the oscillator. Thus, it is difficult to rather accurately control the frequency of the backlight signal to eliminate the flicker. Moreover, some known portable personal computers are provided with a backlight signal having an adjustable duty cycle to reduce battery power consumption. The flicker problem becomes much more apparent at such lower duty cycles.

OBJECTS OF THE INVENTION

Accordingly, it is an object of the present invention to provide a portable personal computer with a fluorescent backlit LCD which solves the problems associated with the prior art.

It is another object of the present invention to provide circuitry which rather accurately controls the frequency of the backlight signal.

It is yet another object of the present invention to provide a fluorescent backlit LCD that does not have a noticeable flicker.

It is yet another object of the present invention to provide a portable personal computer having a fluorescent backlit LCD, synchronized with the display refresh signal.

BRIEF DESCRIPTION OF THE DRAWING

These and other objects and advantages of the present invention will become apparent from the following detailed description and drawing, wherein.

DETAILED DESCRIPTION OF THE INVENTION

The invention relates to a circuit for controlling the frequency of the fluorescent backlight used in a dual layer supertwist LCD, such as described in detail in the December 1988 issue of *Byte Magazine*, pages 321–324, hereby incorporated by reference. The backlit LCD is provided with a compensator to produce a page white display, similar to a typewritten page having a white background with black or grey characters. The backlight comprises a pair of 2.5 watt fluorescent bulbs.

The fluorescent backlit dual supertwist LCD is provided with Zenith Data Systems TurbosPort 386 portable personal computer. The TurbosPort 386 portable personal computer is driven by an Intel 80386 32 bit microprocessor. A CMOS version of the Intel 80386 microprocessor is utilized to reduce battery power consumption. The CMOS version 80386 operates at 12 MHz and is switchable down to 6 MHz to conserve battery power consumption. The machine features zero wait state technology which obviates the need for the microprocessor to slow down to wait for slower components to catch up. This allows the machine to run faster than models with higher clock speeds that have to wait.

The principles of the invention are applicable to various LCD display controllers. For example, the LCD display may be driven by an LCD display controller 15, such as a Chips and Technologies model 82C455 or as Cirrus model chip set CL-GD610/620. These LCD controllers 15 provide a horizontal sync signal HSY; a vertical sync signal VSY, a dot clock signal, eight data signals and a signal to prevent AC bias on the LCD. The latter signal is sometimes provided within the LCD. With such LCDs, it is unnecessary for the LCD controller to provide such a signal.

The horizontal sync HSY and vertical sync VSY signals control the application of the voltage to the electrode matrix in the LCD. The system is set up such that eight parallel bits of data are written to the LCD at a time under control of the dot clock. The first 4 bits are written to the first 4 pixels located at the upper left side of the first line of the display. The second 4 bits are written to the first 4 pixels on the left side of the center row of the display. Subsequent bytes are written in the same manner until the top half and the bottom half of the display are written resulting in a so-called double scan, wherein the display is written half the time it takes to write the screen from top to bottom.

Figure 1:
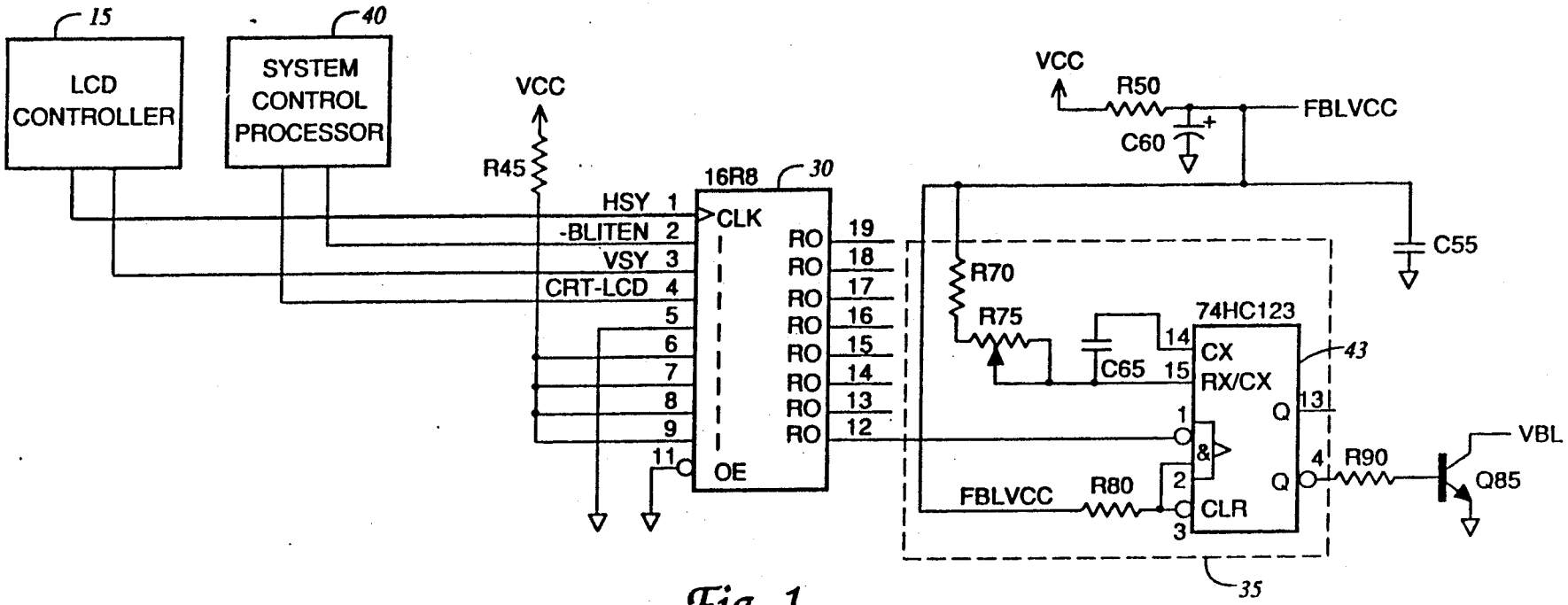
FIG. 1 is a schematic diagram of the backlight control circuitry in accordance with the present invention.
Figure 2:
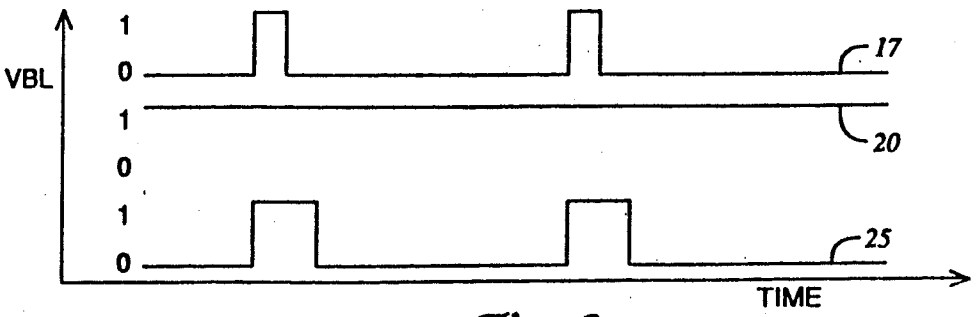
FIG. 2 is an illustration of the output waveforms of the circuitry of FIG. 1.

In order to reduce the noticeable flicker of the backlight, the circuitry in accordance with the present invention provides a backlight control signal VBL, synchronized to the horizontal sync signal HSY. The circuitry is also able to control the brightness of the LCD by controlling the duty cycle of the backlight control signal VBL, for example, as illustrated in FIG. 2. By controlling the duty cycle of the backlight control signal VBL, the power consumption of the battery can be controlled. More particularly, referring to FIG. 2, waveform 17 represents the input to multivibrator 43 from the counter 30. The waveform 20 provides maximum brightness of the LCD while the waveform 25 will provide the minimum brightness. The reduced pulse width of the waveform 25 relative to the waveform 20 consumes less battery power. Since the system is synchronized to the display refresh signal, the circuitry in accordance with the present invention, will eliminate the noticeable flicker of the backlight over the entire duty cycle adjustment range.

The circuitry in accordance with the present invention is comprised of a counter 30 and a pulse width modulator circuit 35. The counter 30 divides the horizontal sync signal HSY by a predetermined number, for example, 50, which will depend on the frequency of the display refresh signal. The counter 30 is formed from programmable array logic (PAL), such as a PAL 16R8 as manufactured by Monolithic Memories, Inc. The CUPL software for configuring the PAL as counter is provided in Table I.

Four signals are provided to the PAL; a horizontal sync signal HSY, a backlight enable signal -BLITEN, a vertical sync signal VSY and a CRT-LCD signal, which identifies to the system which type of display is being driven. The CRT-LCD signal as well as the -BLITEN signal are provided by a system control processor 40, such as a Signetics model 451, which also reads the keyboard and monitors the batteries. When the -BLITEN signal is high, the backlight is turned off after a predetermined amount of time of non-use to conserve battery power. The -BLITEN signal is applied to pin 2 of the counter 30 to disable the counter 30 each time the backlight is turned off. The CRT-LCD signal is applied to pin 4 of the counter 30 and tells the system whether an LCD or a CRT is being driven.

The backlight control signal VBL is synchronized to the horizontal sync signal HSY, applied to pin 1 of the counter 30. The vertical sync signal VSY is applied to pin 3 of the counter 30 to reset the counter 30 after each frame is written. Since different types of LCD controllers can be used, pin 5 is grounded and is used as a flag to identify the type of LCD controller feeding the counter 30. Unused input pins 6, 7, 8 and 9 of the counter 30 are serially connected to a power supply VCC by way of a pull up resistor R45 to pull the inputs high. A resistor R50 and a bypass capacitor C60, preferably an electrolytic capacitor, are also connected to the power supply VCC and form a voltage filter circuit and provide a filtered power supply FBLVCC for the pulse width modulator circuit 35. The voltage filter circuit compensates for any noise in the power supply line FBLVCC to prevent false triggering of the pulse width modulator circuit 35. Another bypass capacitor C55 is connected between the power supply FBLVCC and ground to compensate for any current spikes generated by the pulse width modulator circuit 35.

Pin 11 of counter 30, an operate enable, is tied to ground to permanently enable the counter 30. Pins 12 through 19 of the counter 30 are registered outputs. Only pin 12 is used. The remaining outputs 13 through 19 are not used and are open circuited. The output of the counter 30 on pin 12 is a signal having a frequency which is a fractional multiple of the frequency of the horizontal sync signal HSY. This signal is applied to the input of the pulse width modulator circuit 35.

The pulse width modulator 43 may be a DC retriggerable multivibrator, such as a Motorola 74HC123. The output pulse width is a function of the values of an external timing capacitor C65, a resistor R70 and a variable resistor R75. By varying the resistance of the variable resistor R75, the pulse width or duty cycle of the backlight control signal VBL can be adjusted as illustrated in FIG. 2.

The timing capacitor C65 is connected across pins 14 and 15 of the multivibrator 43. One end of the resistor R70 is serially connected to one end of the variable resistor R75. The other end of variable resistance R75 is connected to pin 15 of the multivibrator 43. The other end of resistor R70 is connected to the power supply line FBLVCC. The filtered power supply signal FBLVCC is also applied to the clear CLR input pins 2 and 3 of the multivibrator 43 by way of a current limiting resistor R80.

The output of the multivibrator 43 is applied to a driver, an NPN transistor Q85, by way of a resistor R90.

The emitter of the transistor Q85 is grounded while the collector provides the backlight control signal VBL and is connected to the fluorescent backlight. The backlight signal VBL is thus synchronized with the display refresh signal to mitigate any noticeable flicker. An exemplary list of component values for the resistors and capacitors is provided in TABLE II.

Obviously, many modifications and variations of the invention as heretofore set forth can be made without departing from the spirit and scope of the appended claims. For example, various digital and analog circuitry may be utilized to provide a backlight signal VBL, synchronized with the display refresh signal. Also, the principles of the invention are equally applicable to monochrome and color LCDs. All such modifications and variations are intended to be within the spirit of the appended claims.

TABLE I

```
/*********************************************************/
/* This PAL divides the LCD Line Clock by 50 to provide a */
/* sync signal for the backlight intensity control circuit */
/* to eliminate flicker. */
/*********************************************************/
/*AllowableTargetDevice Types:PAL16R8 */
/*********************************************************/
/** Inputs **/
pin 1    =lc          ; /* LCD line count clock          */
pin 2    = !bliten    ; /* Display is dark when !active  */
pin 3    = flm        ; /* Start of video frame.         */
pin 4    = crt_lcd    ; /* selects CRT of LCD.           */
pin 5    = !vga       ; /* when low flags the VGA video  */
pin 11   = !oe        ; /*                               */
/** Outputs **/
pin 12   = !50div     ; /* Clock divided by 50           */
pin 13   = !32count   ; /* Clock divided by 64           */
pin 14   = !16count   ; /* Clock divided by 32           */
pin 15   = !8count    ; /* Clock divided by 16           */
pin 16   = !4count    ; /* Clock divided by 8            */
pin 17   = !2count    ; /* Clock divided by 4            */
pin 18   = !1count    ; /* Clock divided by 2            */
/** Intermdiate Equations and Variable definitions **/
field state value =
[50div,32count,16count,8count,4count,2count,1count] ;
/*                cccccc                  */
/*                oooooo                  */
/*               duuuuuu                  */
/*               innnnnn                  */
/*               vtttttt                  */
/*               531                      */
/*               0268421                  */
$define   STATE_A     'b' 0000000
$define   STATE_B     'b' 0000001
$define   STATE_C     'b' 0000010
$define   STATE_D     'b' 0000011
$define   STATE_E     'b' 0000100
$define   STATE_F     'b' 0000101
$define   STATE_G     'b' 0000110
$define   STATE_H     'b' 0000111
$define   STATE_I     'b' 0001000
$define   STATE_J     'b' 0001001
$define   STATE_K     'b' 0001010
$define   STATE_L     'b' 0001011
$define   STATE_M     'b' 0001100
$define   STATE_N     'b' 0001101
$define   STATE_O     'b' 0001110
$define   STATE_P     'b' 0001111
$define   STATE_AA    'b' 0010000
$define   STATE_AB    'b' 0010001
$define   STATE_AC    'b' 0010010
$define   STATE_AD    'b' 0010011
$define   STATE_AE    'b' 0010100
$define   STATE_AF    'b' 0010101
$define   STATE_AG    'b' 0010110
$define   STATE_AH    'b' 0010111
$define   STATE_AI    'b' 0011000
$define   STATE_AJ    'b' 0011001
$define   STATE_AK    'b' 0011010
$define   STATE_AL    'b' 0011011
$define   STATE_AM    'b' 0011100
```

TABLE I-continued

```
$define   STATE_AN    'b' 0011101
$define   STATE_AO    'b' 0011110
$define   STATE_AP    'b' 0011111
$define   STATE_BA    'b' 0100000
$define   STATE_BB    'b' 0100001
$define   STATE_BC    'b' 0100010
$define   STATE_BD    'b' 0100011
$define   STATE_BE    'b' 0100100
$define   STATE_BF    'b' 0100101
$define   STATE_BG    'b' 0100110
$define   STATE_BH    'b' 0100111
$define   STATE_BI    'b' 0101000
$define   STATE_BJ    'b' 0101001
$define   STATE_BK    'b' 0101010
$define   STATE_BL    'b' 0101011
$define   STATE_BM    'b' 0101100
$define   STATE_BN    'b' 0101101
$define   STATE_BO    'b' 0101110
$define   STATE_BP    'b' 0101111
$define   STATE_CA    'b' 0110000 /*  Count to 48 (from 0)
                                      done */
$define   STATE_ZZ    'b' 1000000
nrest = bliten & !flm ;
/** Logic Equations **/
sequence state value {
  present STATE_A
    if !(bliten & !flm)
      # crt_llc & vga
    next STATE_A;
    if (bliten & !flm) & !(crt_lcd & vga)
    next STATE_B;
  present STATE_B
    if !nreset
    next STATE_A;
    if nreset
    next STATE_C;
  present STATE_C
    if !nreset
    next STATE_A;
    if nreset
    next STATE_D;
  present STATE_D
    if !nreset
    next STATE_A;
    if nreset
    next STATE_E;
  present STATE_E
    if !nreset
    next STATE_A;
    if nreset
    next STATE_F;
  present STATE_F
    if !nreset
    next STATE_A;
    if nreset
    next STATE_G;
  present STATE_G
    if !nreset
    next STATE_A;
    if nreset
    next STATE_H;
  present STATE_H
    if !nreset
    next STATE_A;
    if nreset
    next STATE_I;
  present STATE_I
    if !nreset
    next STATE_A;
    if nreset
    next STATE_J;
  present STATE_J
    if !nreset
    next STATE_A;
    if nreset
    next STATE_K;
  present STATE_K
    if !nreset
    next STATE_A;
    if nreset
    next STATE_L;
  present STATE_L
```

TABLE I-continued

```
if !nreset
next STATE_A;
if nreset
next STATE_M;
present STATE_M
if !nreset
next STATE_A;
if nreset
next STATE_N;
present STATE_N
if !nreset
next STATE_A;
if nreset
next STATE_O;
present STATE_O
if !nreset
next STATE_A;
if nreset
next STATE_P;
present STATE_P
if !nreset
next STATE_A;
if nreset
next STATE_AA;
present STATE_AA
if !nreset
next STATE_A;
if nreset
next STATE_AB;
present STATE_AB
if !nreset
next STATE_A;
if nreset
next STATE_AC;
present STATE_AC
if !nreset
next STATE_A;
if nreset
next STATE_AD;
present STATE_AD
if !nreset
next STATE_A;
if nreset
next STATE_AE;
present STATE_AE
if !nreset
next STATE_A;
if nreset
next STATE_AF;
present STATE_AF
if !nreset
next STATE_A;
if nreset
next STATE_AG;
present STATE_AG
if !nreset
next STATE_A;
if nreset
next STATE_AH;
present STATE_AH
if !nreset
next STATE_A;
if nreset
next STATE_AI;
present STATE_AI
if !nreset
next STATE_A;
if nreset
next STATE_AJ;
present STATE_AJ
if !nreset
next STATE_A;
if nreset
next STATE_AK;
present STATE_AK
if !nreset
next STATE_A;
if nreset
next STATE_AL;
present STATE_AL
if !nreset
next STATE_A;
```

TABLE I-continued

```
if nreset
next STATE_AM;
present STATE_AM
if !nreset
next STATE_A;
if nreset
next STATE_AN;
present STATE_AN
if !nreset
next STATE_A;
if nreset
next STATE_AO;
present STATE_AO
if !nreset
next STATE_A;
if nreset
next STATE_AP;
present STATE_AP
if !nreset
next STATE_A;
if nreset
next STATE_BA;
present STATE_BA
if !nreset
next STATE_A;
if nreset
next STATE_BB;
present STATE_BB
if !nreset
next STATE_A;
if nreset
next STATE_BC;
present STATE_BC
if !nreset
next STATE_A;
if nreset
next STATE_BD;
present STATE_BD
if !nreset
next STATE_A;
if nreset
next STATE_BE;
present STATE_BE
if !nreset
next STATE_A;
if nreset
next STATE_BF;
present STATE_BF
if !nreset
next STATE_A;
if nreset
next STATE_BG;
present STATE_BG
if !nreset
next STATE_A;
if nreset
next STATE_BH;
present STATE_BH
if !nreset
next STATE_A;
if nreset
next STATE_BI;
present STATE_BI
if !nreset
next STATE_A;
if nreset
next STATE_BJ;
present STATE_BJ
if !nreset
next STATE_A;
if nreset
next STATE_BK;
present STATE_BK
if !nreset
next STATE_A;
if nreset
next STATE_BL;
present STATE_BL
if !nreset
next STATE_A;
if nreset
next STATE_BM;
```

TABLE I-continued

```
present STATE_BM
  if !nreset
  next STATE_A;
  if nreset
  next STATE_BN;
present STATE_BN
  if !nreset
  next STATE_A;
  if nreset
  next STATE_BO;
present STATE_BO
  if !nreset
  next STATE_A;
  if nreset
  next STATE_BP;
present STATE_BP
  if !nreset
  next STATE_A;
  if nreset
  next STATE_CA;
present STATE_CA
  if !nreset
  next STATE_A;
  if nreset
  next STATE_ZZ;
present STATE_ZZ
  next STATE_A;
}
```

TABLE II

| EXEMPLARY COMPONENT VALUES | |
|---|---|
| COMPONENT | VALUE |
| R45 | 10K ohms |
| R50 | 22K ohms |
| C55 | 0.1 microfarads |
| C60 | .47 microfarads |
| C65 | .047 farads |
| R70 | 10K ohms |
| R75 | 100K ohms |
| R80 | 10K ohms |
| Q85 | — |
| R90 | 1K ohms |

What is claimed and sought to be secured by letters patent is:

1. A control circuit for driving a backlight for a display which mitigates noticeable flicker from the backlight comprising:

means for receiving a source of signals representative of horizontal sync signals which drive the display; and means responsive to said receiving means for providing a backlight control signal of a predetermined frequency synchronized to said horizontal sync signal which includes a counter, wherein said counter divides said horizontal sync signal by a predetermined number.

2. A control circuit as recited in claim 1, wherein said predetermined number is 50.

3. A control circuit as recited in claim 1, wherein said predetermined frequency is 450 Hz.

4. A control circuit as recited in claim 1, further including means for resetting said counter after each frame of the display is written.

5. A control circuit as recited in claim 4 wherein said receiving means also receives a source of signals representative of vertical sync signals which drive the display.

6. A control circuit as recited in claim 4, wherein said resetting means is responsive to a vertical sync signal.

7. A control circuit as recited in claim 4, wherein said resetting means also includes means for receiving a source of signals for enabling the backlight.

8. A control circuit as recited in claim 7, wherein said resetting means includes means for resetting the counter each time the backlight is enabled.

9. A control circuit as recited in claim 1, wherein said providing means includes means for controlling the duty cycle of the backlight control signal.

10. A control circuit as recited in claim 9, wherein said controlling means includes a pulse width modulator.

11. A control circuit as recited in claim 10, wherein said pulse width modulator includes a multivibrator.

12. A control circuit as recited in claim 11, further including means for adjusting the pulse width output of the multivibrator.

13. A control circuit for driving a backlight of an LCD display which mitigates noticeable flicker comprising:

means for receiving a source of signals representative of horizontal sync and vertical sync signals which drive the display;

a counter, electrically coupled to said receiving means, which divides the horizontal sync signal by a predetermined number and provides a counter output signal;

a pulse width modulator which receives said counter output signal and provides an output signal having a predetermined duty cycle, synchronized to said horizontal sync signals; and driving means responsive to said output signal from said pulse width modulator, which provides a backlight control signal for driving a fluorescent backlight without noticeable flicker, synchronized to said horizontal sync signals.

14. A control circuit as recited in claim 13, wherein said driving means includes a transistor.

15. A control circuit as recited in claim 14, wherein said transistor is an NPN transistor.

16. A control circuit as recited in claim 13, further including means for adjusting the duty cycle of the backlight control signal.

17. A control circuit as recited in claim 16, wherein said adjusting means includes a variable resistor.

18. A control circuit as recited in claim 13, wherein said resetting means is responsive to the vertical sync signal.

19. A method for controlling the flicker of a backlight for a backlit LCD comprising the steps of:

(a) providing a source of signals representative of horizontal sync signals used to drive the LCD;

(b) generating a signal for driving said backlight from said horizontal sync signals having a predetermined frequency; said predetermined frequency being generated by dividing the frequency of said horizontal sync signals by a predetermined number.

20. A method as recited in claim 19, further including the following step:

(c) adjusting the pulse width of said driving signal.

* * * * *

UNITED STATES PATENT AND TRADEMARK OFFICE

CERTIFICATE OF CORRECTION

PATENT NO. : 5,184,117

DATED : February 2, 1993

INVENTOR(S) : LLoyd W. Gauthier

It is certified that error appears in the above-identified patent and that said Letters Patent is hereby corrected as shown below:

Column 1, line 30, delete "plasma d" and substitute --plasma displays-- therefor.

Column 5, Table I, line 28, delete "selects CRT of LCD" and substitute --selects CRT or LCD-- therefor.

Column 6, Table I, line 23, delete "sequence state value" and substitute --sequence state_value-- therefor.

Column 6, Table I, line 24, delete "#crt_llc & vga" and substitute --#crt_lcd & vga-- therefor.

Column 9, claim 1, line 51, delete "signal" and substitute --signals-- therefor.

UNITED STATES PATENT AND TRADEMARK OFFICE

CERTIFICATE OF CORRECTION

PATENT NO. : 5,184,117

DATED : February 2, 1993

INVENTOR(S) : LLoyd W. Gauthier

It is certified that error appears in the above-identified patent and that said Letters Patent is hereby corrected as shown below:

Column 9, claim 1, line 52, delete "signal" and substitute --signals-- therefor.

Column 9, claim 3, line 57, delete "450 Hz" and substitute --420 Hz-- therefor.

Column 10, claim 13, line 27, delete "signal" and substitute --signals-- therefor.

Column 10, claim 18, line 50, delete "signal" and substitute --signals-- therefor.

Signed and Sealed this

Sixteenth Day of November, 1993

*Attest:*

*Attesting Officer*

Bruce Lehman

BRUCE LEHMAN

*Commissioner of Patents and Trademarks*